US009636730B2

(12) United States Patent
Xu et al.

(10) Patent No.: US 9,636,730 B2
(45) Date of Patent: May 2, 2017

(54) APPARATUS FOR CORRECTING UPWARD DEFORMATION OF LARGE MEMBER OF STAINLESS STEEL CAR ROOF

(75) Inventors: Xiaoyang Xu, Changchun (CN); Ting Wang, Changchun (CN)

(73) Assignee: CHANGCHUN RAILWAY VEHICLES CO. LTD, Changchun, Jilin (CN)

( * ) Notice: Subject to any disclaimer, the term of this patent is extended or adjusted under 35 U.S.C. 154(b) by 416 days.

(21) Appl. No.: 13/701,101

(22) PCT Filed: Jul. 12, 2011

(86) PCT No.: PCT/CN2011/077052

§ 371 (c)(1),
(2), (4) Date: Feb. 7, 2013

(87) PCT Pub. No.: WO2012/022205

PCT Pub. Date: Feb. 23, 2012

(65) Prior Publication Data

US 2013/0133393 A1 May 30, 2013

(30) Foreign Application Priority Data

Aug. 19, 2010 (CN) ..... 2010 2 0501493 U

(51) Int. Cl.
*B21D 1/12* (2006.01)
*B21D 1/14* (2006.01)

(52) U.S. Cl.
CPC . *B21D 1/12* (2013.01); *B21D 1/14* (2013.01)

(58) Field of Classification Search
CPC ... B21D 1/06; B21D 1/10; B21D 1/12; B21D 1/14; B21D 1/145; B21D 11/02; B21D 11/20; B21D 25/02; B21D 25/04
(Continued)

(56) References Cited

U.S. PATENT DOCUMENTS 1,358,396 A * 11/1920 Robison ..... 72/292
1,487,839 A * 3/1924 Claybourn ..... 72/342.4
(Continued)

FOREIGN PATENT DOCUMENTS

CN 1137953 A 12/1996
CN 2885486 Y 4/2007
(Continued)

OTHER PUBLICATIONS

International Search Report for corresponding International Patent Application No. PCT/CN2011/077052 mailed Oct. 20, 2011.

*Primary Examiner* — Edward Tolan
*Assistant Examiner* — Gregory Swiatocha
(74) *Attorney, Agent, or Firm* — Merchant & Gould P.C.

(57) ABSTRACT

The utility model provides an apparatus for correcting upwarp deformation of a large member of a stainless steel car roof, being characterized in that, it has a crossbeam, end support columns, a middle support column, an arc-shaped positioning body, crossbeam pull rings, a thin steel taut strap, and tighteners. The end support columns, crossbeam, and middle support column constitute a supporting part, the arc-shaped positioning body having the same arc shape as an inner arc of the large member of the stainless steel car roof is arranged on the middle support column. The thin steel taut strap covers an exterior contour surface of the large member of the stainless steel car roof, and is connected via the tightener to the crossbeam pull rings respectively fixed at two ends of the crossbeam.

2 Claims, 1 Drawing Sheet

(58) Field of Classification Search
USPC ..... 72/292, 296, 305, 302, 705, 457, 458, 72/459, 460, 461
See application file for complete search history.

(56) References Cited

U.S. PATENT DOCUMENTS

| | | | | | |
|---|---|---|---|---|---|
| 2,517,547 | A * | 8/1950 | Derginer | B21D 1/06 | 72/466.6 |
| 2,517,701 | A * | 8/1950 | Oettinger, Jr. | 264/571 | |
| 2,825,385 | A * | 3/1958 | Allen | 72/31.1 | |
| 2,948,327 | A * | 8/1960 | Horner | 72/292 | |
| 3,796,084 | A | 3/1974 | Jarman | | |
| 3,819,153 | A | 6/1974 | Hurst et al. | | |
| 5,323,631 | A * | 6/1994 | Weykamp et al. | 72/296 | |
| 6,171,037 | B1 * | 1/2001 | Andre | B60P 3/075 | 410/10 |

FOREIGN PATENT DOCUMENTS

| | | | |
|---|---|---|---|
| CN | 200951773 | Y | 9/2007 |
| CN | 201530388 | U | 7/2010 |
| CN | 201776317 | U | 3/2011 |
| GB | 1 377 513 | A | 12/1974 |

* cited by examiner

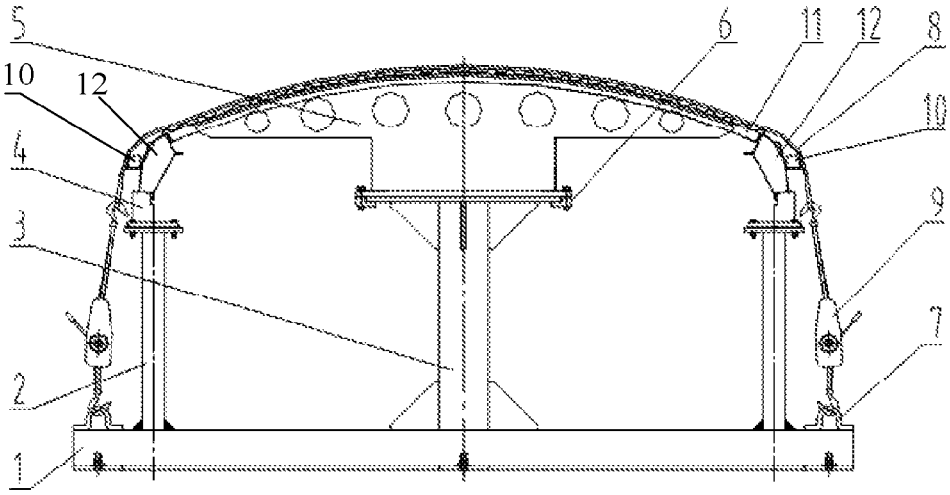
5
10
12
4
3
2
1
6
11
12
8
10
9
7

APPARATUS FOR CORRECTING UPWARD DEFORMATION OF LARGE MEMBER OF STAINLESS STEEL CAR ROOF

This application is a National Stage Application of PCT/CN2011/077052, filed 12 Jul. 2011, which claims benefit of Ser. No. 201020501493.4, filed 19 Aug. 2010 in China and which applications are incorporated herein by reference. To the extent appropriate, a claim of priority is made to each of the above disclosed applications.

FIELD OF INVENTION

The present utility model relates to field of manufacturing a rail car, more particularly, to an apparatus for correcting upwarp deformation of a large member of a stainless steel car roof, for example, during production of rail cars in Hong Kong Subway and associated vehicles.

DESCRIPTION OF THE RELATED ART

Now, both ends of a large member of a stainless steel car roof for a rail car will warp upwardly after assembling and welding, resulting in serious deformations, which could not be solved by conventional methods such as heating or depressing down of a heavy object with ideal correction effects.

SUMMARY OF INVENTION

One object of the present utility model is to provide an apparatus for correcting upwarp deformation of a large member of a stainless steel car roof, solve the above problem due to serious upwarp deformations of the both ends of the large member of the stainless steel car roof for the rail car after assembling and welding, and achieve a purpose of restoring sizes such as the arc shape of the car roof and the car width.

In order to achieve the above object, the present disclosure provides an apparatus for correcting upwarp deformation of a large member of a stainless steel car roof. The apparatus comprises a crossbeam, end support columns, a middle support column, an arc-shaped positioning body, crossbeam pull rings, a thin steel taut strap, and tighteners, the end support columns, the crossbeam, and the middle support column constitute a supporting part, the arc-shaped positioning body having the same arc shape as an inner arc of the large member of the stainless steel car roof is arranged on the middle support column, the thin steel taut strap covers an exterior contour surface of the large member of the stainless steel car roof, and is connected via the tightener to the crossbeam pull rings respectively fixed at two ends of the crossbeam.

Support blocks are respectively mounted on upper portions of the end support columns to support side beams at both ends of the large member of the stainless steel car roof.

Wood blocks underlay edges of the large member of the stainless steel car roof to prevent compression deformation.

With the present utility model, the following advantage effects can be achieved: (1) the thin steel taut strap is used to cover an exterior contour surface of the large member of the stainless steel car roof, and is pulled downwardly through a pull force from the tightener (corresponding to a chain block), so that a portion of the large member of the stainless steel car roof that has upwardly warped and deformed will be displaced downwardly; (2) the arc-shaped positioning body is provided to fit in with the inner arc of the large member of the stainless steel car roof so as to provide a support, thereby achieving accurate restoration of sizes such as the arc shape of the car roof and the car width while achieving correction of deformation.

BRIEF DESCRIPTION OF THE DRAWINGS

FIG. 1 is a diagram showing a whole structure of the apparatus for correcting upwarp deformation of a large member of a stainless steel car roof, under working state, according to the present utility model.

DETAILED DESCRIPTION OF PREFERRED EMBODIMENTS

With reference to FIG. 1, a crossbeam 1 is fixed onto the ground, and end support columns 2, a middle support column 3 and crossbeam pull rings 7 are welded and fixed on the crossbeam 1. Support blocks 4 are respectively mounted on upper portions of the end support columns 2 to support side beams 12 located at end of a large member 11 of a stainless steel car roof. An arc-shaped positioning body 5, having the same arc shape as an inner arc of the large member 11 of the stainless steel car roof, is mounted on an upper portion of the middle support column 3 so as to support an arc inner surface of the large member 11 of the stainless steel car roof. The arc-shaped positioning body 5 and the middle support column 3 are clamped by using a clip block 6 and fixed by using bolts. A circular hole is formed in the surface of the arc-shaped positioning body 5 to reduce weight thereof. The large member 11 of the stainless steel car roof is placed on the arc-shaped positioning body 5 and the support blocks 4, the thin steel taut strap 8 covers an exterior contour surface of the large member 11 of the stainless steel car roof, and wood blocks 10 underlay the side beams 12 of the large member 11 of the stainless steel car roof to prevent compression deformation. Hooks of the tightener 9 (corresponding to a chain block) are used to hook the thin steel taut strap 8 and the crossbeam pull rings 7, and a pull-down force is generated by moving reciprocally an operation lever of the tightener 9 so as to pull the thin steel taut strap downwardly. Since the pull-down force causes a portion of the large member 11 of the stainless steel car roof that has upwardly warped and deformed to be displaced downwardly, until the portion of the large member 11 of the stainless steel car roof that has upwardly warped and deformed fits in with the arc-shaped positioning body 5, thereby achieving accurate restoration of sizes such as the arc shape of the car roof and the car width while achieving correction of deformation.

What is claimed is:

1. An apparatus for correcting upwarp deformation of a large member of a stainless steel car roof, the apparatus comprising a crossbeam, end support columns, a middle support column, an arc-shaped positioning body, crossbeam pull rings, a thin steel taut strap, and tighteners, the end support columns, the crossbeam, and the middle support column constituting a supporting part, the arc-shaped positioning body being configured to support an arc inner surface of the large member and having the same arc shape as an inner arc of the large member of the stainless steel car roof and being arranged on the middle support column, the thin steel taut strap configured to cover an exterior contour surface of the large member of the stainless steel car roof, and being connected via the tighteners to the crossbeam pull rings respectively fixed at two ends of the crossbeam, and the apparatus further comprises support blocks respectively mounted on upper portions of the end support columns to support side beams of the large member of the stainless steel car roof located at either end of the large member.

2. The apparatus for correcting upwarp deformation of a large member of a stainless steel car roof according to claim 1, further comprising wood blocks each configured to be disposed between a corresponding one of the side beams of the large member of the stainless steel car roof and the thin steel taut strap to prevent compression deformation.

* * * * *